US006339407B1

(12) United States Patent
Gabriel et al.

(10) Patent No.: US 6,339,407 B1
(45) Date of Patent: Jan. 15, 2002

(54) ANTENNA ARRAY WITH SEVERAL VERTICALLY SUPERPOSED PRIMARY RADIATOR MODULES

(75) Inventors: Roland Gabriel, Griesstätt; Maximilian Göttl, Grosskarolinenfeld, both of (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 09/673,726

(22) PCT Filed: May 20, 1999

(86) PCT No.: PCT/EP99/03483

§ 371 Date: Oct. 20, 2000

§ 102(e) Date: Oct. 20, 2000

(87) PCT Pub. No.: WO99/62138

PCT Pub. Date: Dec. 2, 1999

(30) Foreign Application Priority Data

May 27, 1998 (DE) ..... 198 23 750

(51) Int. Cl.[7] ..... H01Q 21/26
(52) U.S. Cl. ..... 343/797; 343/810
(58) Field of Search ..... 343/795, 797, 343/798, 853, 810

(56) References Cited

U.S. PATENT DOCUMENTS

| | | | | |
|---|---|---|---|---|
| 3,475,758 A | * | 10/1969 | Vito | 343/797 |
| 3,710,340 A | | 1/1973 | Mayes | |
| 4,434,425 A | | 2/1984 | Barbano | |
| 5,173,715 A | * | 12/1992 | Rodal et al. | 343/795 |
| 5,274,391 A | | 12/1993 | Connolly | |
| 5,629,713 A | * | 5/1997 | Mailandt et al. | |
| 6,023,244 A | * | 2/2000 | Snygg et al. | 343/700 MS |
| 6,025,812 A | * | 2/2000 | Gabriel et al. | 343/797 |

FOREIGN PATENT DOCUMENTS

| | | |
|---|---|---|
| DE | 1 036 336 | 8/1958 |
| DE | 1 160 513 | 1/1964 |
| DE | 7142601.2 | 11/1971 |
| DE | 2 150 660 | 4/1972 |
| EP | 0 124 047 A | 11/1984 |
| EP | 0 685 900 A1 | 12/1995 |
| EP | 0 698 938 A2 | 2/1996 |
| WO | 98/01923 A | 1/1998 |
| WO | 98/36472 | 8/1998 |
| WO | 98/48480 | 10/1998 |
| WO | 99/17403 | 4/1999 |

OTHER PUBLICATIONS

Heilmann, A.: Antennen, Zweiter Teil, Wien/Zürich, 1970, S. 47–50.

Zehentner, H.: "Neue Sendeantenne Für terrestrisches Fernsehen . . . ", Berlin, Offenbach, 1994, S. 357–352.

Gotthard, O.: "Optimierung des Entwufes von Rund–funk und TV–Antennen . . . ", Berlin, Offenbach, 1990, S. 163–169.

Patent Abstracts of Japan vol. 10, No. 58 (E–386), Mar. 1986 & JP 60 210011 A (Yagi Antenna) abstract.

* cited by examiner

*Primary Examiner*—Tan Ho
(74) *Attorney, Agent, or Firm*—Nixon & Vanderhye P.C.

(57) ABSTRACT

An improved antenna array comprises at least two primary radiator modules located in front of a reflector and vertically superimposed at a distance from one another. The primary radiator modules are provided in first and second types having different horizontal half-value widths and constructional configuration. It is possible using this arrangement to obtain a different total half-width value of the combined antenna arrangement.

15 Claims, 6 Drawing Sheets

ANTENNA ARRAY WITH SEVERAL VERTICALLY SUPERPOSED PRIMARY RADIATOR MODULES

FIELD OF THE INVENTION

The invention relates to an antenna array having a plurality of primary radiator modules arranged vertically one above the other.

BACKGROUND OF THE INVENTION

Antenna arrays having primary radiators arranged vertically one above the other are known per se. In the case of dual-polarized antennas, these primary radiators arranged one above the other can emit or receive two orthogonal polarizations. Furthermore, these primary radiators, which are arranged to form an array, can also be referred to as primary radiator modules. Such modules may comprise, for example, simple dipoles, slots, planar radiator elements or so-called patch radiators, as are known, for example, from EP 0 685 900 A1 or from the prior publication "Antennen [Antennas], 2nd Part, Bibliographisches Institut, Manheim [sic]/Vienna/Zurich, 1970, pages 47 to 50. The dipole arrangements are preferably dipoles arranged in a cruciform (cross) shape (cross-dipoles) or double dipole arrangements whose plan view is a square structure (dipole square).

Dual-polarized antennas are, furthermore, also known, for example from WO 98/01923.

In the cited prior art, primary radiator modules having the same radiation characteristics are in each case combined to form arrays. In contrast to this, the interconnection of antennas having different radiation characteristics is used to supply different regions. In this case, there is a disadvantage that the phase relationship in the overlapping area of the two polar diagrams is undefined, leading alternately to cancellation or additive superimposition. The polar diagram that results from this in the overlapping region is in this case unknown.

Multiband antennas are also known, in which different primary radiators for different frequency bands are interconnected with the aim of broadening the frequency band of the antenna. However, in this case, each radiator acts at a different frequency.

The interconnection of different frequency radiators with a continuously varying size extent is also known for the purpose of broadening the frequency band (for example, logarithmic antennas or leakage wave antennas).

Particularly in the mobile radio area, there is a requirement to design and to set antennas such that their polar diagram corresponds to a desired, predetermined half-value width. The setting of the horizontal half-value width of linear, vertically stacked arrays, which correspond to the typical configuration of such base station antennas for mobile radio, is in this case carried out using known means and measures by choosing the half-value width of the primary radiators and by appropriate tuning using the reflector. Once again, primary radiators having the same design are generally used.

A disadvantage of the previously known configurations is that the phase relationship of the primary radiators is unknown and, furthermore, no defined interconnection of different primary radiators to form arrays for the purpose of influencing the radiation characteristics in a defined manner is known, inter alia as a result of this difficulty.

SUMMARY OF THE INVENTION

The preferred embodiment of the present invention provides an antenna array which comprises at least two primary radiator modules arranged vertically one above the other, and in which, with comparatively simple means, an improved implementation of a desired horizontal half-value width of the antenna array is possible.

In accordance with one aspect provided by the invention, an antenna array comprises at least two radiator modules or radiators (1, 3) arranged vertically one above the other, which are located in front of a reflector (5) and are fed by a preferably common feed network with a defined power and phase. At least one first primary radiator module or one first radiator (1) of a first type and at least one second primary radiator module or one second radiator (3) of a second type are provided, which are arranged at a distance vertically one above the other. The at least one or the plurality of primary radiator module or modules or the at least one first radiator (1) of the first type has or have a different horizontal half-value width to the at least one or the plurality of primary radiator module or modules or the at least one second radiator (3) of the second type. As a result, the overall antenna can have an overall horizontal half-value width which is different to this.

In accordance with another aspect provided by the invention, the at least one or the plurality of primary radiator module or modules or the at least one first radiator (1) of the first type has or have a different physical design to the at least one or the plurality of primary radiator module or modules or the at least one second radiator (3) of the second type.

A further aspect of this invention provides an antenna array comprising a first and a second radiator (1, 3) which are arranged vertically one above the other in front of a reflector (5) and emit in the same direction. The first radiator (1) has a different design to the second radiator (3), and the first radiator (1) also has a different horizontal half-value width to the second radiator (3). When the first radiator (1) and the second radiator (3) are being operated together, they form an overall half-value width which is different to both the half-value width of the first radiator (1) and to the half-value width of the second radiator (3) when being operated on their own.

It must be regarded as entirely surprising that the solution according to the invention makes it possible, by appropriate selection of different primary radiator modules, to tune the half-value width of such an antenna array. It should also be mentioned that, in this case, it is possible to interconnect the modules with the defined phase relationship by appropriate design of the feed network.

It is also surprising that the combination of the modules according to the invention can be used to optimize the vertical polar diagram, for example in order to achieve a reduction in the side lobes. This is possible because the at least two primary radiator modules used have different horizontal and vertical half-value widths. By interconnecting these at least two different primary radiator modules to form a linear, vertically stacked array, it is possible to adjust the horizontal half-value width of the overall antenna.

The antennas according to the invention can be constructed using primary radiator modules which comprise double dipoles and single dipoles.

The invention can be used just as well with dual-polarized antennas which, for example, operate with a +/−45° polarization alignment (so-called X arrays).

If, for example, a combination of three single dipoles with a typical half-value width of 90° and three double dipoles with a typical half-value width of 65° corresponding to the invention is arranged vertically one above the other (thus, in other words, they are assembled to form a so-called linear, vertically stacked antenna array), then this gives a resultant horizontal half-value width of approximately 75°.

In the case of dual-polarized antennas with, for example, a +/− 45° polarization alignment, a resultant horizontal half-value width of approximately 75° can be produced and used by such a combination of cross-dipoles (horizontal half-value width of, for example, approximately 85°) and dipole squares (with a horizontal half-value width of, for example, approximately 65°).

In one preferred embodiment of the invention, the various groups of primary radiator modules in this case have considerably different horizontal half-value widths, which thus differ from one another by more than 5°, in particular by more than 10°, 15° or 20°.

Alternatively, it is just as possible for the antenna arrays according to the invention to be formed using primary radiators in the form of patch radiators with a considerably different half-value width.

In one preferred embodiment of the invention, the primary radiators may comprise dual-polarized radiators. The primary radiators may be formed by dipole squares and cross-dipoles.

The antenna according to the invention may be used to transmit or receive in widely differing frequency bands. Normally, in the mobile radio field, such an antenna is operated in a frequency band range from 1.71 to 1.90 GHz, that is to say with a mid-frequency of about 1.80 GHz.

BRIEF DESCRIPTION OF THE DRAWINGS

The invention will be explained in more detail in the following text with reference to exemplary embodiments. In this case, in detail, in the figures.

DETAILED DESCRIPTION OF PRESENTLY PREFERRED EXAMPLE

Embodiments

Figure 1:
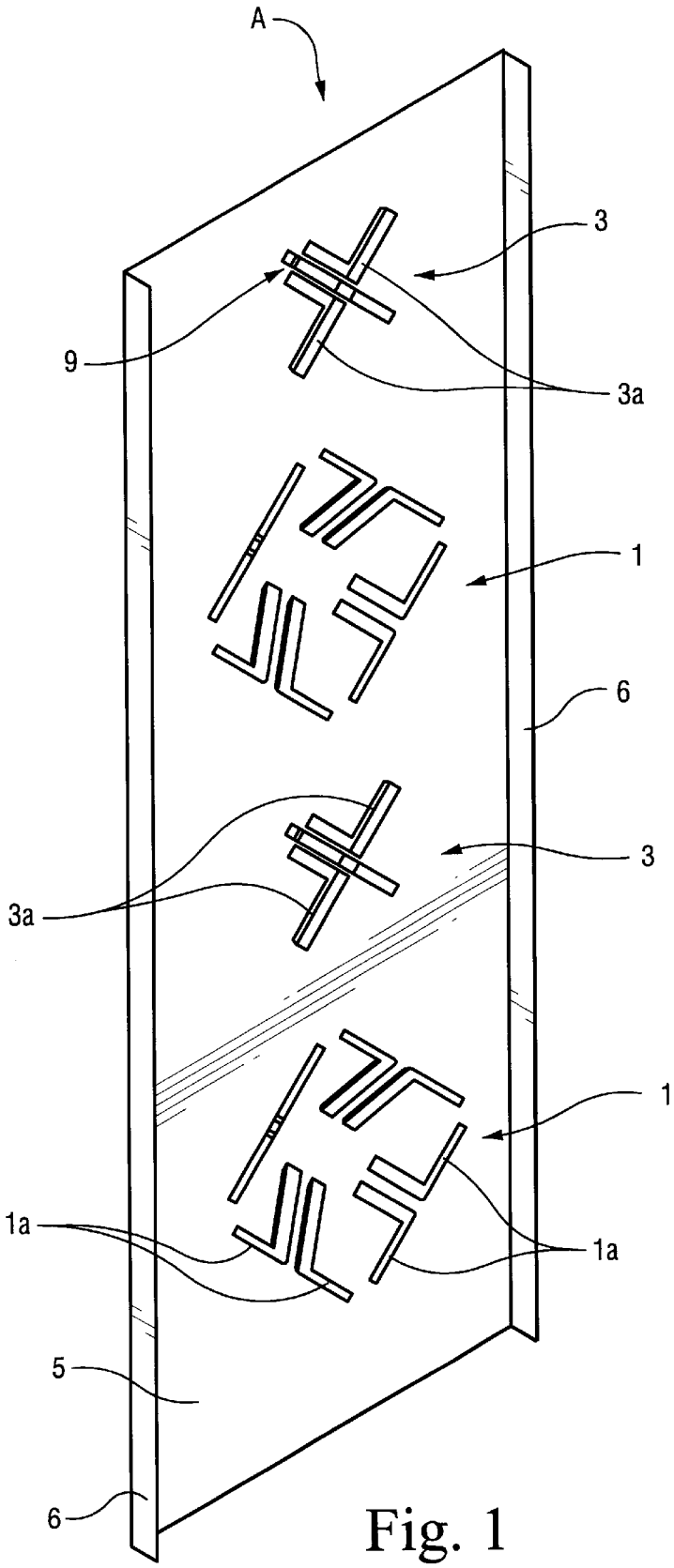
FIG. 1 shows a schematic perspective view of an antenna array according to the invention.
Figure 2:
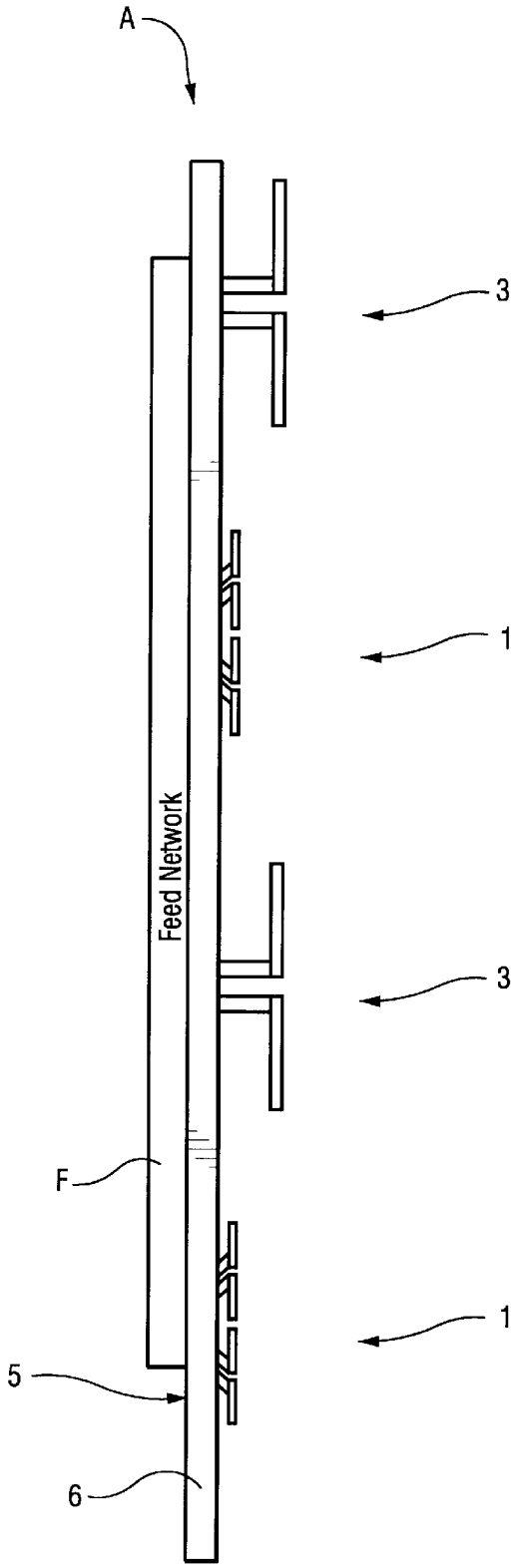
FIG. 2 shows a side view of the exemplary embodiment shown in FIG. 1.

FIGS. 1 and 2 show a schematic perspective plan view and a horizontal side view, respectively, of a first exemplary embodiment of an antenna array A according to the invention having a plurality of primary radiator modules 1, 3 arranged vertically one above the other, with this antenna array subsequently partially also being shown as a linear, vertically stacked antenna array.

This antenna array A thus comprises radiator modules 1 and 3 which are arranged in front of a reflector 5, which is shaped rectangularly in the exemplary embodiment shown and whose larger longitudinal extent is aligned in the vertical direction.

The reflector 5 is conductive. A feed network F can be located on the rear face of the reflector, via which the first radiator module 1 and the second radiator module 3 are electrically connected. As a rule, a common feed network F is provided for this purpose, via which the first and second group of radiator modules 1, 3 are fed with a defined power and phase to form the vertical radiation characteristics. In this case, the feed network F in addition also carries out the compensation for the different phase relationship between the various primary radiator modules. The first radiator module 1 in this case comprises a plurality of dipoles 1*a*, namely, in the exemplary embodiment shown in FIG. 1, four dipoles 1*a*, which are arranged like a dipole square. The dipoles 1*a* are mechanically held via a so-called balancing element 7 (see FIG. 3) with respect to the reflector or a panel located behind it, and electrical contact is made with them, that is to say they are fed, via the said feed network F.

Both the primary radiator modules belonging to the first and second groups, that is to say the radiator modules 1 and 3, are designed such that the length of the dipole elements is roughly the same and is tuned to the desired frequency band. A dual-polarized antenna (also referred to, for short, as an X-polarized antenna) is provided in a known manner by the orthogonal alignment of the dipole elements 1*a* (for the first radiator module 1) and 3*a* (for the second radiator module 3, which will be described in the following text), in which the dipoles 1*a* and 3*a* are respectively aligned at an angle of +45° and −45° to the vertical (or, equally well, to the horizontal).

The reflector plate 5 itself has a reflector rim 6, which is in each case in the horizontal emission direction and which, in the exemplary embodiment shown, projects at right angles from the plane of the reflector plate 5 to a certain height, and by which means the polar diagram can also be influenced in an advantageous manner.

Radiator modules 3 are now located offset between the radiator modules 1 formed as a type of dipole square. These second radiator modules 3 in the illustrated exemplary embodiment are not in the form of dipole squares, but are in the form of a cross-dipole. The two dipoles 3*a*, which are positioned orthogonally to one another, are likewise, like the balancing element 9 associated with them, once again mechanically supported and electrically fed via the reflector 5 or a panel located behind it.

The vertical distance between two adjacent radiator modules 1 and 3 always corresponds to half the distance between two radiator modules 1 and two radiator modules 3 in the preferred exemplary embodiment. In other words, a radiator module from the one group is always arranged centrically between the vertical separation between two radiator modules of the other group in the illustrative embodiment.

Both groups of radiator modules 1 and 3 are fed by a common feed network F with a defined power and phase in order to form the vertical radiation characteristics. In other words, both radiator modules are operated in the same frequency band. When using dipole elements, for example in the form of cross-dipoles, dipole squares etc., the dipoles thus, as normal, are of approximately the same length.

As can also be seen in particular from the side view shown in FIG. 2, the individual dipole elements 1*a*, 3*a* need not be located at the same common height. The distance between the plane of the reflector 5 and the plane of the dipoles 1*a* and 3*a* is preferably not more than one wavelength and not less than 1/20 of the wavelength. Particularly advantageous ranges are obtained when the distance between the reflector 5 and the plane of the dipole elements 1*a*, 3*a* is not more than 40% of the wavelength, and preferably not more than 30% of the wavelength.

The term "wavelength" means the operating wavelength related to the operating frequency or the frequency band range of the antenna in which it is operated. In the illustrated exemplary embodiment, the antenna would be operated in a range from 1.71 GHz to about 1.90 GHz, that is to say it would have a mid-frequency of about 1.80 GHz. Such antennas are used in the mobile radio field. Suitable lower cut-off values for the distance under discussion between the dipoles and the plane of the reflector are those which are of the order of 10% or more, in particular 20% or ¼ of the wavelength (operating wavelength). In this case, the dipoles 1*a* need not be located in the same distance plane from the reflector 5 as the dipoles 3*a*, as can also be seen from FIG. 2.

It can also be seen from the exemplary embodiment shown in FIGS. 1 and 2 that the balancing elements 7 which support the dipoles, for example for the dipole square, but just as well the balancing elements 9 which support the dipoles 3*a* for the second group of primary radiator modules, need not run at right angles to the reflector plane, but may run obliquely to it. In the same way, the distance between the dipole elements and the plane of the reflector 5 may be less than ¼ of the wavelength, for example less than 0.2 of the wavelength. Alternatively, other holders may also be provided for the dipoles which need not at the same time operate for the purposes of the balancing elements.

Thus, in the illustrated exemplary embodiment, the linear, vertically stacked antenna array in each case comprises two pairs of antenna modules 1 and 3, with the antenna modules 1 being formed by dipole squares, and the antenna modules 3 being formed by cross-dipoles.

In the illustrated exemplary embodiment of a dual-polarized antenna with a polarization alignment of, for example, +/−45°, the combination of the radiator modules 1 in the form of cross-dipoles with a horizontal half-value width of, for example, approximately 85° with the radiator modules 3 in the form of the said dipole squares with a horizontal half-value width of approximately 65° leads to the overall dual-polarized antenna having a resultant horizontal half-value width of approximately 75°.

Figure 3:
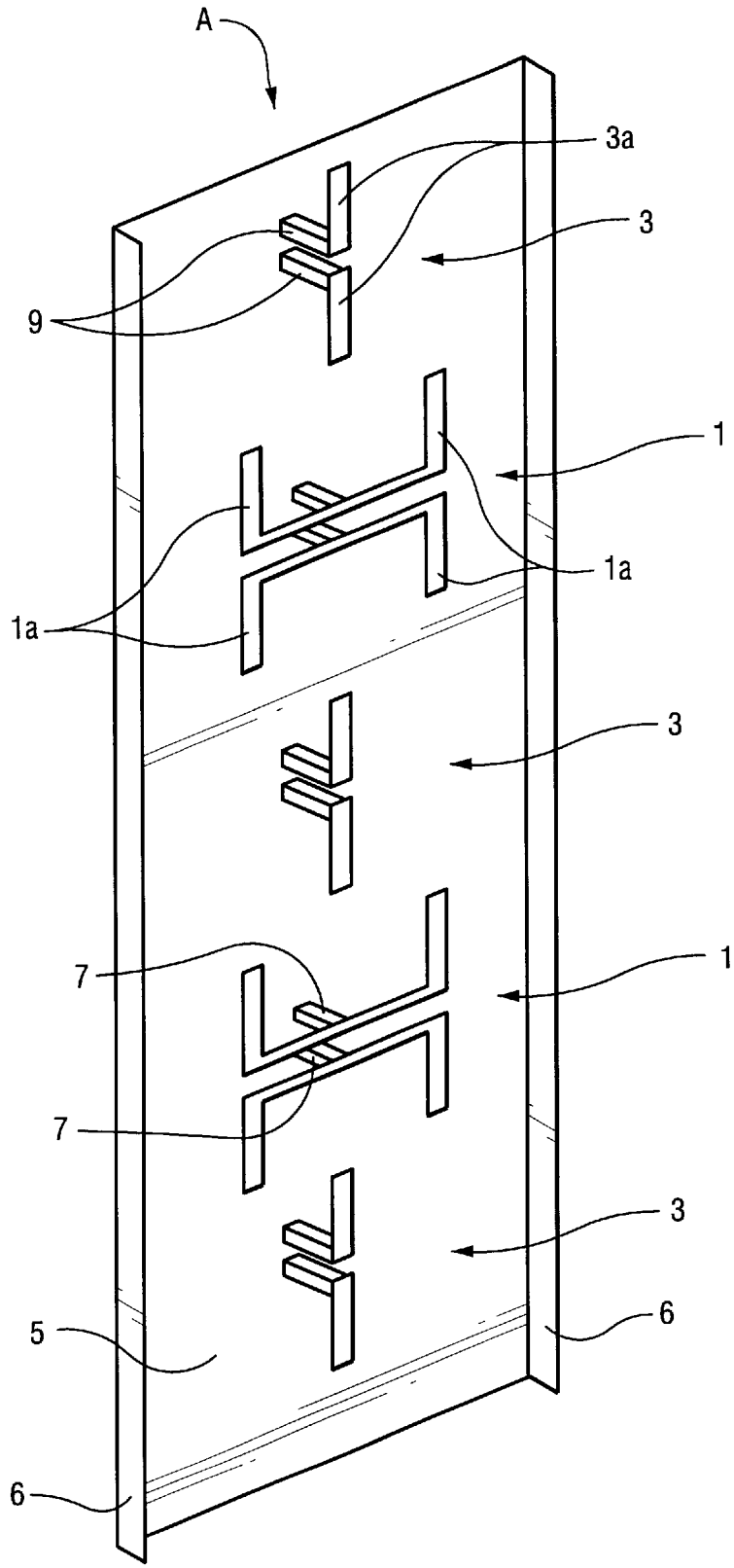
FIG. 3 shows a schematic perspective view of a modified antenna array according to the invention, in the form of linear radiators.
Figure 4:
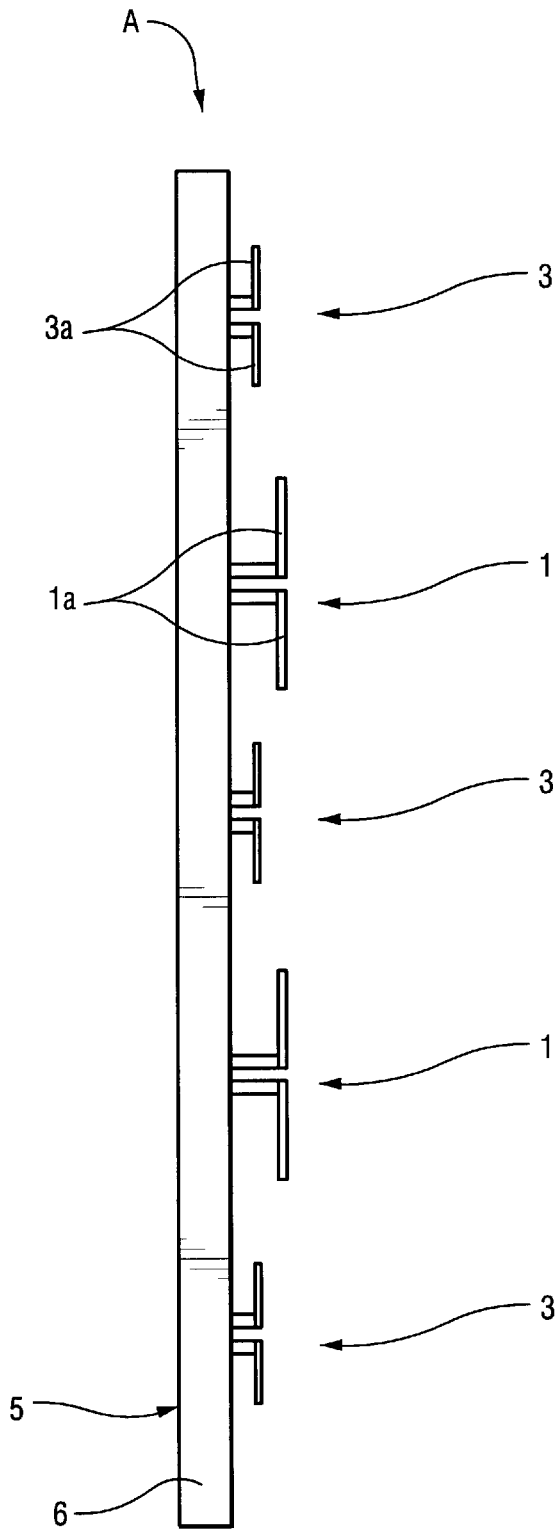
FIG. 4 shows a side view of the exemplary embodiment shown in FIG. 3.

A modified exemplary embodiment as shown in FIGS. 3 and 4 will be referred to in the following text, in which the first and second groups of radiator modules do not comprise +/−45° dual-polarized primary radiator modules 1, 3, but linear polarized radiator modules 1, 3.

The radiator modules 1 in this case comprise dipoles 1*a* which are aligned in the vertical direction and are arranged in duplicated form, alongside one another with a lateral offset, in the horizontal direction.

The radiator modules 3 which are in each case linear polarized are arranged in between each two duplicated, single-polarized primary radiator modules 1 formed in this way, and each comprise a vertically aligned dipole 3*a*.

Furthermore, FIG. 3 also once again shows the balancing elements 7 for the radiator modules 1 and the balancing elements 9 for the radiator modules 3.

With reference to this exemplary embodiment and from FIGS. 3 and 4 it can also be seen that the design of the antenna with respect to the horizontal plane is also symmetrical, that is to say the number of radiator modules 3 is odd (in this exemplary embodiment comprising three modules), while, in contrast, the radiator modules 1 in the intermediate intervals occur only twice.

Figure 5:
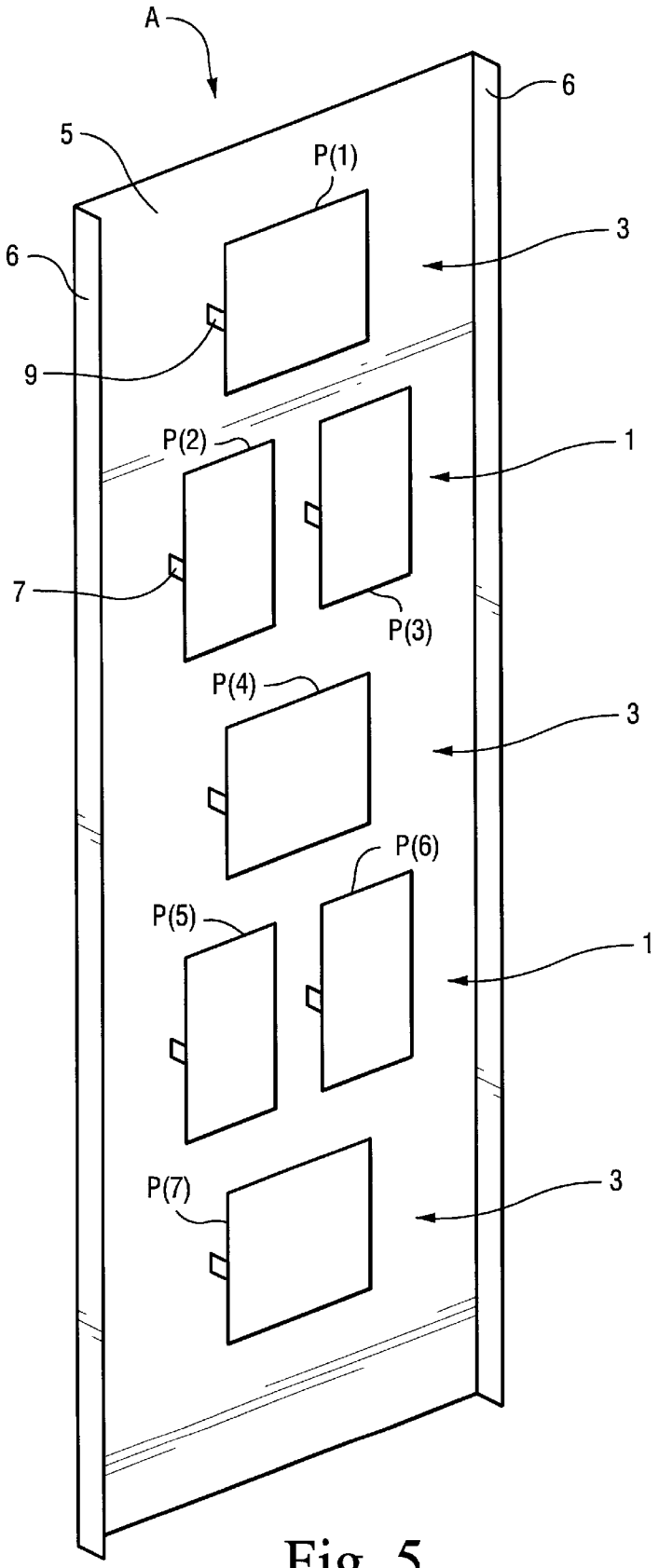
FIG. 5 shows a schematic perspective view of an antenna array according to the invention in the form of a patch radiator.

The exemplary embodiment in FIG. 5 shows a modification for patch radiators P, which are likewise once again fixed via appropriate holders 7 and 9.

The radiator modules 1 in this case comprise duplicated patch radiators which are arranged horizontally alongside one another with a lateral offset, while, in contrast, only one of each of the patch radiators which belong to the second group are provided. Apart from this, the design of the antenna array formed in this way is also comparable to the preceding exemplary embodiments, with the distance between the plane of the reflector 5 and the plane of the patch radiator elements being less, as is known.

Figure 6:
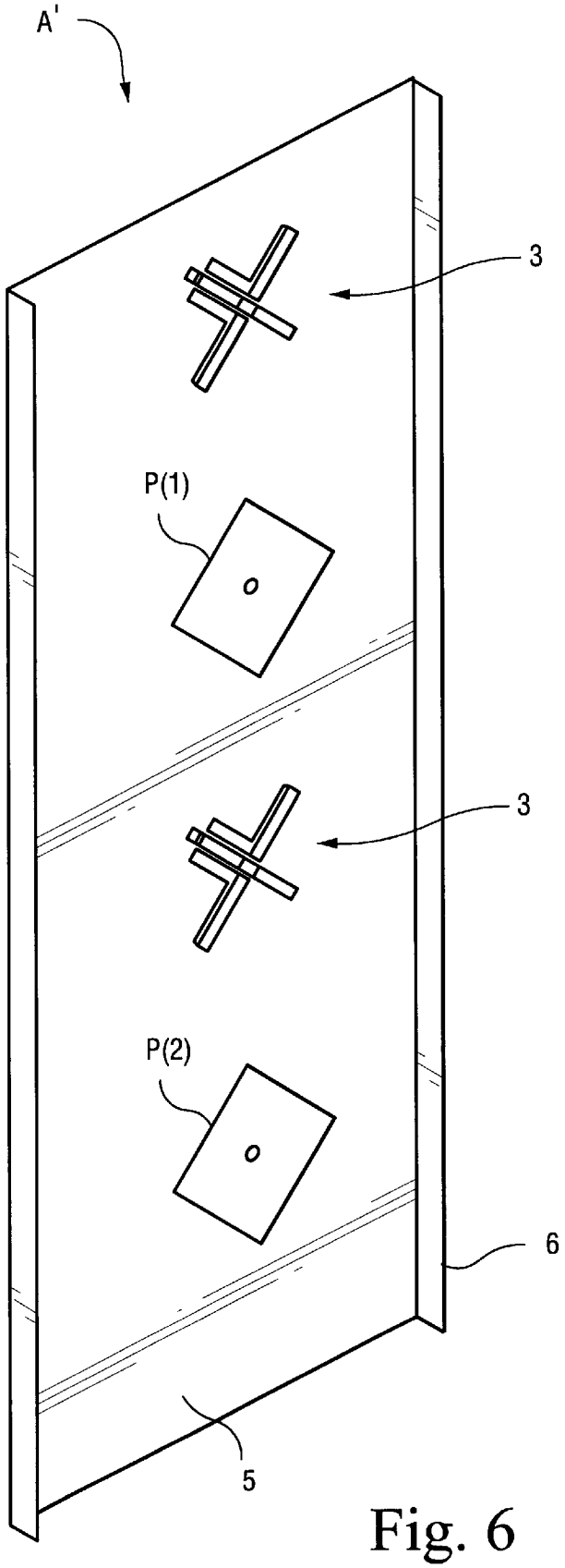
FIG. 6 shows a schematic perspective view of an additional antenna array embodiment including both cross-dipole and patch radiators.

As shown in FIG. 6, the first primary radiator modules or radiators (1) can comprise dipoles (1*a*, 3*a*), and the second primary radiator modules or radiators (3) comprise patch radiators P.

As can be seen from the exemplary embodiments, either an equal number of primary radiator modules 1 of the first type and primary radiator modules 3 of the second type can be provided, or this number may differ, preferably by one, thus forming a symmetrical antenna design with respect to a horizontal plane, as well.

What is claimed is:

1. In an antenna array comprising: a reflector, at least two radiators arranged vertically one above the other, which are located in front of the reflector, and a common feed network with a defined power and phase that feeds the at least two radiators, an arrangement comprising:

at least one first primary radiator structure of a first type having a predetermined polarization;

at least one second primary radiator structure of a second type arranged at a distance vertically above the first primary radiator structure, said second primary radiator structure having the same predetermined polarization as the first primary radiator structure, the at least one first primary radiator structure of the first type having a different horizontal half-value width than the at least one second primary radiator structure of the second type, and the at least one first radiator structure of the first type having a physical design that is different from the physical design of the at least one second radiator structure of the second type.

2. The antenna array according to claim 1, further comprising a plurality of first primary radiator structures and a plurality of second primary radiator structures arranged alternately vertically with the plurality of first primary radiator structures.

3. The antenna array according to claim 1, characterized in that the at least one first primary radiator structure and the at least one second primary radiator structure comprise linear polarized antennas.

4. The antenna array according to claim 1, wherein the at least one first primary radiator structure comprises double dipoles, and the at least one second primary radiator structure comprises single dipoles.

5. The antenna array according to claim 1, wherein at least one of the first and second primary radiator structures comprises a dual-polarized antenna.

6. The antenna array according to claim 1, wherein at least one of the first and second primary radiator structures comprises a patch radiator.

7. The antenna array according to claim 1, wherein the antenna array comprises a combination of radiators, which have more than two different types, whose designs differ.

8. The antenna array according to claim 1, wherein the number of first primary radiator structures is even, and the number of second primary radiator structures is odd.

9. In an antenna array comprising first and second radiators arranged vertically one above the other in front of a reflector and to emit in the same direction, said first and second radiators each having a design and a horizontal half-value width, the array further comprising:

the first radiator design being different design from the second radiator design, the first radiator and the second radiator having the same polarization, the first radiator horizontal half-value width being different from the second radiator horizontal half-value width, and wherein in use, when the first radiator and the second radiator are being operated together, they cooperate to provide an overall half-value width which is different from the first radiator half-value width and the second radiator half-value width.

10. The antenna array according to claim 9, wherein the half-value widths of the first and second radiators differ from one another by at least 10°.

11. The antenna array according to claim 9, wherein the half-value widths of the first and second radiators differ from one another by at least 20°.

12. The antenna array according to claim 9, wherein the half-value widths of the first and second radiators differ from one another by at least 25°.

13. The antenna array according to claim 9, wherein the half-value widths of the first and second radiators differ from one another by at least 30°.

14. In an antenna array comprising: a reflector, at least two radiators arranged vertically one above the other, which are located in front of the reflector, and a common feed network with a defined power and phase that feeds the at least two radiators, an arrangement comprising:

at least one first primary radiator structure of a first type;

at least one second primary radiator structure of a second type arranged at a distance vertically above the first primary radiator structure, the at least one first primary radiator structure of the first type having a different horizontal half-value width than the at least one second primary radiator structure of the second type, and the at least one first radiator structure of the first type having a physical design that is different from the physical design of the at least one second radiator structure of the second type, wherein the first primary radiator structure comprises a dipole square, and the second primary radiator structure comprises a cross-dipole, to provide a dual-polarized antenna array.

15. In an antenna array comprising: a reflector, at least two radiators arranged vertically one above the other, which are located in front of the reflector, and a common feed network with a defined power and phase that feeds the at least two radiators, an arrangement comprising:

at least one first primary radiator structure of a first type;

at least one second primary radiator structure of a second type arranged at a distance vertically above the first primary radiator structure, the at least one first primary radiator structure of the first type having a different horizontal half-value width than the at least one second primary radiator structure of the second type, and the at least one first radiator structure of the first type having a physical design that is different from the physical design of the at least one second radiator structure of the second type, wherein the first primary radiator structure comprises a dipole, and the second primary radiator structure comprises a patch radiator.

* * * * *